US005123264A

United States Patent [19]

Simmons

[11] Patent Number: 5,123,264

[45] Date of Patent: Jun. 23, 1992

[54] TELEPHONE EARRINGS

[76] Inventor: June S. Simmons, 337 Bird Key Dr., Sarasota, Fla. 34236

[21] Appl. No.: 759,671

[22] Filed: Sep. 13, 1991

[51] Int. Cl.[5] ..... A44C 7/00

[52] U.S. Cl. ..... 63/12

[58] Field of Search ..... 63/12, 13, 1.1, 20; D11/40, 42, 86, 87, 88; 24/705

[56] References Cited

U.S. PATENT DOCUMENTS

| | | | |
|---|---|---|---|
| D. 147,214 | 7/1947 | Dawer | D11/40 |
| 253,472 | 2/1882 | De Mur | 63/12 |
| 2,647,379 | 8/1953 | Ferro | 63/12 |
| 3,033,010 | 5/1962 | Pintarelli | 63/12 |
| 3,208,239 | 9/1965 | Pintarelli | 63/12 |
| 3,575,013 | 4/1971 | Chernow | 63/12 |
| 4,653,292 | 3/1987 | Maupin | 63/12 |

FOREIGN PATENT DOCUMENTS

| | | | |
|---|---|---|---|
| 102184 | 3/1894 | Fed. Rep. of Germany | 63/13 |
| 2180137 | 3/1987 | United Kingdom | 63/12 |
| 2187633 | 9/1987 | United Kingdom | 63/12 |

*Primary Examiner*—Renee S. Luebke
*Assistant Examiner*—F. Saether
*Attorney, Agent, or Firm*—Dominik, Stein, Saccocio, Reese, Colitz & Van Der Wall

[57] ABSTRACT

A one piece earring comprising a decorative part having a slot, the slot being formed to extend from the periphery to a central section thereof, the decorative part also having a bar joining the two sides of the slot and located intermediate the periphery and the central section. An inverted J-shaped hook comprising a short section and a long section with a curved section therebetween, the short section having its end formed as a ring, the inverted J-hook being pivotally connected to the bar by the ring to allow for the extended rotation of the J-shaped hook through the slot.

8 Claims, 2 Drawing Sheets

TELEPHONE EARRINGS

BACKGROUND OF THE INVENTION

1. Field of the Invention

This invention relates to one piece earrings for pierced ears and, more particularly, to an earring which has a decorative part with a slot formed from its upper outer periphery to a middle area adjacent to an aperture. A transversely extending bar separates the slot from the aperture. An inverted J-shaped hook with a loop is pivotally connected to the bar for increased comfort when the wearer is talking on the telephone.

2. Description of the Background Art

Increasing numbers of both women and men are piercing their ears. As a result, the demand for earrings suitable for pierced ears is growing. Conventional earrings for pierced ears are comprised of two pieces. One piece contains the decorative section with a post section. The post is the section which is inserted through the hole of the earlobe of the wearer. The second piece is the stud. The stud is made to releasably lock over the end of the post section and insures that, once the earring is in place, the post section does not slip out of the ear lobe hole.

There are many problems which arise from conventional two piece earrings. One such problem is that the earring backing creates an uncomfortable pressure upon the lobe of the wearer. Such is also true of older clip-on earrings for non-pierced ears. Another problem results from phone usage since larger two piece earrings have a tendency to be uncomfortable when speaking on a phone. This is because they are located between the phone and the ear. To avoid the earring being uncomfortably sandwiched between the phone and ear, a wearer will take often off the earring before picking up a receiver. Such is also true for earrings for non-pierced ears. Still yet another problem arises due to the two piece nature of conventional earrings. The earring studs are frequently lost, making the decorative piece useless.

A wide variety of techniques are either employed commercially or are disclosed in the patent literature as attempting to solve the problems of conventional earrings. Note for example U.S. Pat. No. 2,629,989 to McDonald; U.S. Pat. No. 3,353,372 to Rapaport; U.S. Pat. No. 4,221,118 to Chicckine; U.S. Pat. No. 4,869,078 to Leith et al. and U.S. Pat. No. 4,879,882 to Johnson et al. All of these patents are substantially the same from the standpoint that the decorative part hangs below the pierced ear hole of the wearer minimizing the decorative effort of the earring. The present invention offers a decorative piece that extends above the pierced hole of the wearer, thereby substantially increasing the aesthetic value of the earring. U.S. Pat. No. 247,873 to Bassett does disclose an earring which extends partially above the pierced hole of the wearer, but it requires a complex spring biasing system incorporated into the pivot mechanism thereby increasing cost and complexity.

As illustrated by the large quantity of background art and commercial devices, efforts are continuously being made in an attempt to improve earrings and their means of attachment to the ear lobe. No prior effort, however, suggests the present inventive combination of component elements arranged and configured as disclosed herein. Prior earrings do not provide the benefits attendant with the present invention. The present invention achieves its purposes, objects and advantage over the prior art through a new, useful and unobvious combination of component elements, through the use of a minimum number of functioning parts, and through the use of only readily available materials and conventional components.

It is, therefore, an object of the present invention to provide a one piece earring comprising a decorative part having a slot, the slot being formed from the periphery to a central section thereof, the decorative part also having a bar joining the two sides of the slot and located near the base of the slot; and an inverted J-shaped hook comprising a short section and a long section with a curved section therebetween, the short section having its end formed as a ring, the inverted J-hook being pivotally connected to the bar by the ring to allow for the extended rotation of the J-shaped hook through the slot.

It is a further object of the present invention to expand the decorative part of an earring and have it extend partially above the pierced ear hole of the wearer.

It is a further object of the present invention to increase user convenience by constructing a decorative part which is rotatable with respect to the J-shaped hook to facilitate easy removal from the ear as well as placement into the ear.

It is a further object of the present invention to maximize earring comfort by a design wherein the majority of the decorative part is located at the bottom section of the ear to facilitate the placement of a phone receiver adjacent a wearer's ear without an earring section therebetween.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

For the purpose of summarizing this invention, this invention may be incorporated into a one piece earring comprising a decorative part having a slot, the slot being formed from the periphery to a central section thereof, the decorative part also having a bar joining the two sides of the slot and located near the base of the slot; and an inverted J-shaped hook comprising a short section and a long section with a curved portion therebetween, the short section having its end formed as a ring, the inverted J-hook being pivotally connected to the bar by the ring to allow for the extended rotation of the J-shaped hook through the slot.

The slot is formed from the upper outer periphery to a generally central section of the decorative part or to a generally upper section of the decorative part. The bar is formed at the middle section of the slot to allow for greater rotation of the inverted J-shaped hook therebetween. The top of the slot is located above the entire J-shaped hook.

The invention may also be incorporated in an earring comprising a decorative part having a slot formed from the upper outer periphery to a central section and a hole formed below the first slot to provide a bar therebetween; and an inverted J-shaped hook comprising a short section and a long section with a curved section therebetween, the long section of the hook having a smaller bend adjacent to its center and the short section having a loop at its end, the diameter of the loop being greater in diameter than the width of the bar to allow for rotation of the ring about the bar, the diameter of the inverted hook being smaller than the width of the slot to allow for passage therethrough, the slot being of a length greater than the length of the short section of the hook whereby at least a section of the decorative piece is entirely above the hook.

The invention may also be incorporated into an earring comprising a shepherds crook and a plate, the shepherds crook being formed with a short section and a long section with a central section therebetween, the shepherds crook having a loop at one end thereof, the plate having a slot with a bar at the interior end of the slot for the receipt of the loop.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the Figures.

DETAILED DESCRIPTION OF THE INVENTION

Figure 1:
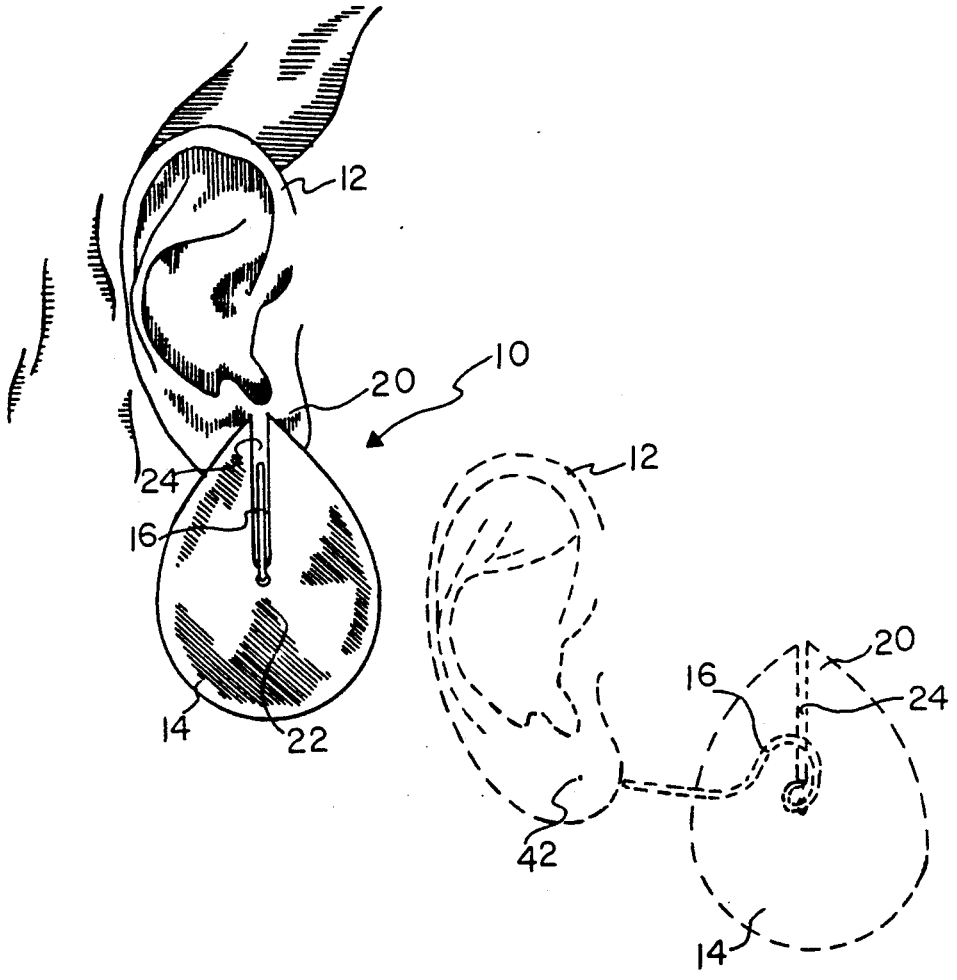
FIG. 1 is a front elevational illustration of the primary embodiment of an earring constructed in accordance with the principles of the present invention with a dotted line showing the earring prior to being positioned on the ear.
Figure 2:
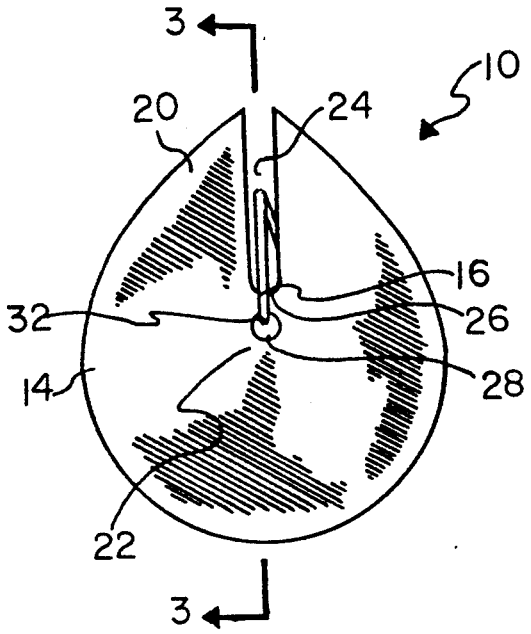
FIG. 2 is an enlarged front elevational view of the earring as shown in FIG. 1.
Figure 3:
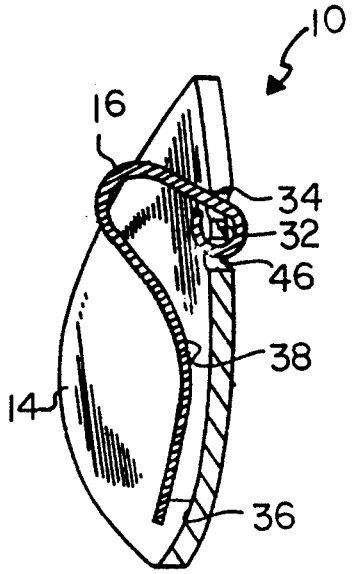
FIG. 3 is an enlarged side sectional view of the earring taken along line 3—3 of FIG. 1.

FIG. 1 is a perspective illustration of an earring 10 constructed in accordance with the principles of the instant invention, the earring 10 being positioned on an ear 12. In association therewith is a dotted line showing the ear 12 with the earring 10 oriented immediately prior to positioning on the ear 12.

The earring 10 is of a one piece construction, fabricated of two joined parts, a generally plate-like decorative part 14 and wire in the form of a J-shaped hook or shepherds crook 16.

The novelty of the present invention is found in the specific construction of each of the pieces as well as the coupling therebetween.

The decorative part 14 is much like the decorative part of a conventional earring, whether of the one piece or two piece type. The decorative part 14 is formed from an essentially rigid material, preferably gold. However, as with conventional earrings, the decorative part may be made from almost any essentially rigid material such as metal, plastic or wood. The decorative part may be of any desired shape peripherally and may be flat, dished, partially spherical, etc. Additionally, various patterns or designs may be added to the surface of the decorative piece. These designs may be accomplished by various types of paints or texturing techniques.

Formed from the upper outer periphery 20 to a central section 22 of decorative part 14 is a slot 24. At the bottom section 26 of the slot is a hole 28 having a size equal to or slightly larger than the width of the slot 24. Between the slot 24 and hole 28, there is formed a bar 32. The bar 32 extends across the width of slot 24 and hole 28. The width of bar 32 in the preferred embodiment is approximately 0.05 inches. The width of the slot 24 is large enough to facilitate the passage of the inverted J-shaped hook 16 therethrough. In the preferred embodiment, the width of slot 24 is approximately 0.10 inches and is uniform throughout its length.

Pivotally connected to decorative part 14 is the inverted J-shaped hook 16. The inverted J-shaped hook 16 is comprised of a short leg 34 and a long leg 36 with a curved section 38 therebetween. The length of the short leg is less than the length of the slot. In this manner, the top of the slot is above the curved section of the J-shaped hook and hole of the ear. This hides the J-shaped hook and ear hole to extend the size of the decorative piece for greater aesthetic appeal.

The J-shaped hook 16 may be made from a variety of materials. In the preferred embodiment it is made of a rigid material, preferably gold. However, any material may be used which is rigid enough to be inserted through a hole 42 in pierced ear 12 and which resists corrosion and other effects detrimental to the pierced ear. The diameter of the J-shaped hook 16 should be such that it can be easily inserted into the hole 42 of the pierced ear 12 upon which it is worn. In the preferred embodiment, the diameter of the J-shaped hook 16 is approximately 0.05 inches.

At the end of the short section 34 of the J-shaped hook 16 is a loop or ring 46. The ring 46 is of the same material and thickness as the rest of J-shaped hook 16. In the preferred embodiment, the ring 46 is simply made by forming the end of the J-shaped hook 16 into a generally circular configuration. The ring 46 is formed about the bar 32 and permits the pivotal connecting of the decorative part 14 and the J-shaped hook 16. The diameter of the ring 46, therefore, must be smaller than the width of the slot and hole but greater than the width of the bar 32 in order to facilitate the pivotal connection therebetween. In the preferred embodiment, the diameter of the ring 46 is 0.10 inches.

The pivotal connection as described allows for rotation of the inverted J-shaped hook 16 from an essentially vertical orientation when worn, to an essentially horizontal orientation when putting it on or taking it off. Note FIG. 1.

Thus, when the earring 10 is in place within the ear 12, it is possible to rotate the decorative part 14 to an essentially horizontal position aligned with the axis of the hole 42 of the ear 12. This position allows for easy removal of the earring 10 as well as easy placement of the J-shaped hook 16 into the ear 12. The ability of the decorative part 14 to rotate in relation to the ear 12, along with the placement of the majority of the decorative part 14 at the lower section of the ear 12 facilitates the use of the earring 10 in conjunction with a phone receiver. Specifically, in most instances, the wearer will hold a telephone directly against the ear with no earring part therebetween. In instances where the upper part of the earring would be between the ear and phone, the wearer may rotate the top of the earring down, rotating it on the curved section of the hook, out of the way of the wearer.

When a wearer of an earring is using the telephone, the telephone normally pushes against the earring. Because the wire of the present invention has the ability to pivot when contacted by a phone, the wire moves forward, toward the earring, and away from the mastoid, that bone behind the ear lobe. Therefore there is no discomfort or pain in wearing the earring of the present invention as is normally associated with prior pierced earrings. Because of this cantilevered motion, the present earring feels weightless on the ear. This is an added comfort to the wearer.

Figure 4:
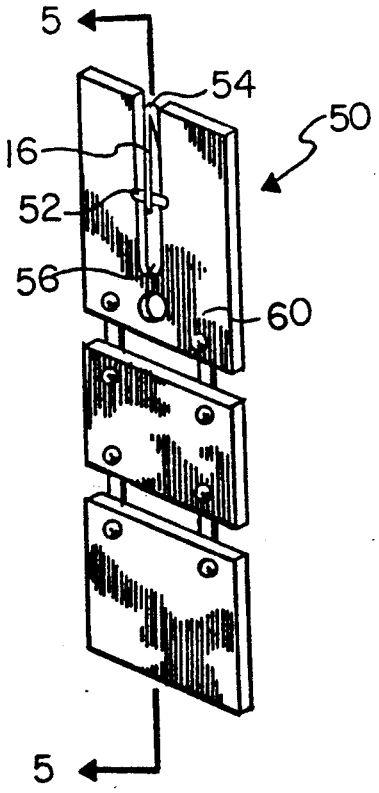
FIG. 4 is an enlarged perspective view of an earring but showing an alternate embodiment of the invention.
Figure 5:
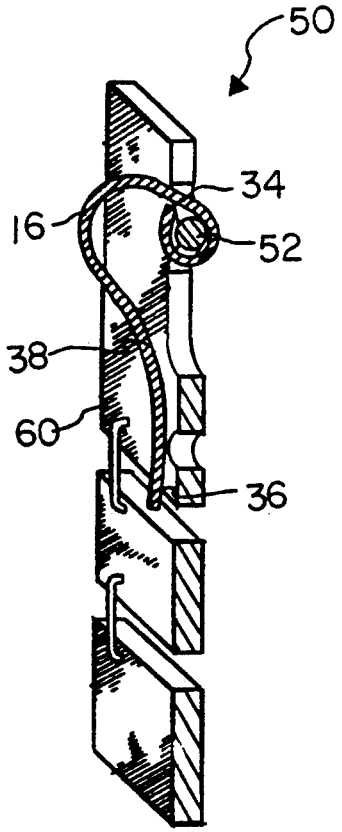
FIG. 5 is an enlarged perspective sectional view of the earring of FIG. 4 but from the reverse side along line 5—5.

Disclosed above is the primary embodiment of the earring 10. However, a secondary embodiment of the invention is disclosed in FIGS. 4 and 5. FIG. 4 is an enlarged elevational view of the second embodiment of the earring 50. The primary difference in the secondary embodiment is that the bar 52 is located more centrally along the slot 54. The hole beneath the bar is a slot 56, of greater length than the small hole of the primary embodiment. Such construction increases the extent to which the J-shaped hook may rotate with respect to the decorative piece. Additional decorative components 60 may depend from the decorative part for increasing the aesthetic value of the earring.

The present disclosure includes that contained in the appended claims as well as that of the foregoing description. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. An earring comprising:

a decorative part having a periphery, means forming a slot extending from said periphery to a central section of said decorative part, said slot having a width, means forming a hole adjacent said slot means, a bar extending across said slot means, said bar having a width; and a wire in the form of an inverted J-shaped hook comprising a short section and a long section with a curved section therebetween, the long section of the hook having a bend intermediate its ends, the short section having a loop at its end, said loop encircling said bar, the diameter of the loop being greater than the width of the bar to allow for rotation of the loop about the bar, the diameter of the wire being smaller than the width of the slot means to allow for its passage therethrough, the slot means being of a length greater than the length of the short section of the hook whereby at least a section of the decorative part is entirely above the hook.

2. The earring of claim 1 wherein said slot means has a width of approximately 0.10 inches and said wire has a diameter of approximately 0.05 inches.

3. The earring of claim 2 wherein said bar has a width of approximately 0.05 inches and the encircling loop has a diameter of about 0.10 inches.

4. The earring of claim 3 wherein said hole means is of a size at least equal to said slot width.

5. The earring of claim 1 wherein said hole means is of a size at least equal to said slot width.

6. The earring of claim 5 wherein said slot means has a width of approximately 0.10 inches and said wire has a diameter of approximately 0.05 inches.

7. The earring of claim 5 wherein said bar has a width of approximately 0.05 inches and the encircling loop has a diameter of about 0.10 inches.

8. The earring of claim 1 wherein said bar has a width of approximately 0.05 inches and the encircling loop has a diameter of about 0.10 inches.

* * * * *